United States Patent [19]

Nuns et al.

[11] Patent Number: 4,673,781

[45] Date of Patent: Jun. 16, 1987

[54] ELECTROMAGNETIC INDUCTION DEVICE FOR HEATING METAL ELEMENTS

[75] Inventors: Jacques Nuns, Ecuelles; Joseph Abraham, Rouffach, both of France

[73] Assignees: Electricite de France, Paris; Celes, Lautenbach, both of France

[21] Appl. No.: 749,303

[22] Filed: Jun. 27, 1985

[30] Foreign Application Priority Data

Jun. 28, 1984 [FR] France ..... 84 10225

[51] Int. Cl.[4] ..... H05B 6/42

[52] U.S. Cl. ..... 219/10.49 R; 219/10.43; 219/10.57; 219/10.75

[58] Field of Search ..... 219/10.79, 10.49 R, 219/10.43, 10.57, 10.71, 10.73, 10.75, 10.61 R

[56] References Cited

U.S. PATENT DOCUMENTS

| | | | |
|---|---|---|---|
| 2,457,843 | 1/1949 | Strickland . | |
| 3,467,806 | 9/1969 | Dixon | 219/10.79 X |
| 3,663,782 | 5/1972 | Emerson | 219/10.43 |
| 4,029,926 | 6/1977 | Austin | 219/10.49 R |
| 4,281,234 | 7/1981 | DoHogne | 219/10.57 X |
| 4,359,620 | 11/1982 | Keller | 219/10.73 |

FOREIGN PATENT DOCUMENTS

| | | |
|---|---|---|
| 2315502 | 10/1973 | Fed. Rep. of Germany . |
| 2404371 | 4/1979 | France . |
| 2489645 | 3/1982 | France . |
| 1421493 | 1/1976 | United Kingdom . |

*Primary Examiner*—Philip H. Leung
*Attorney, Agent, or Firm*—Michael N. Meller

[57] ABSTRACT

An electromagnetic induction apparatus for heating metal elements has at least one flat loop magnetic circuit open at its two facing ends, with an inductor wound onto the magnetic circuit. The inductor has two windings wound onto the magnetic circuit, respectively in the vicinity of the two ends of the loop, which windings are supplied by in-phase alternating currents. Each end of the flat loop is chamfered, the ends forming an air gap therebetween, in which the element to be heated is placed.

6 Claims, 1 Drawing Figure

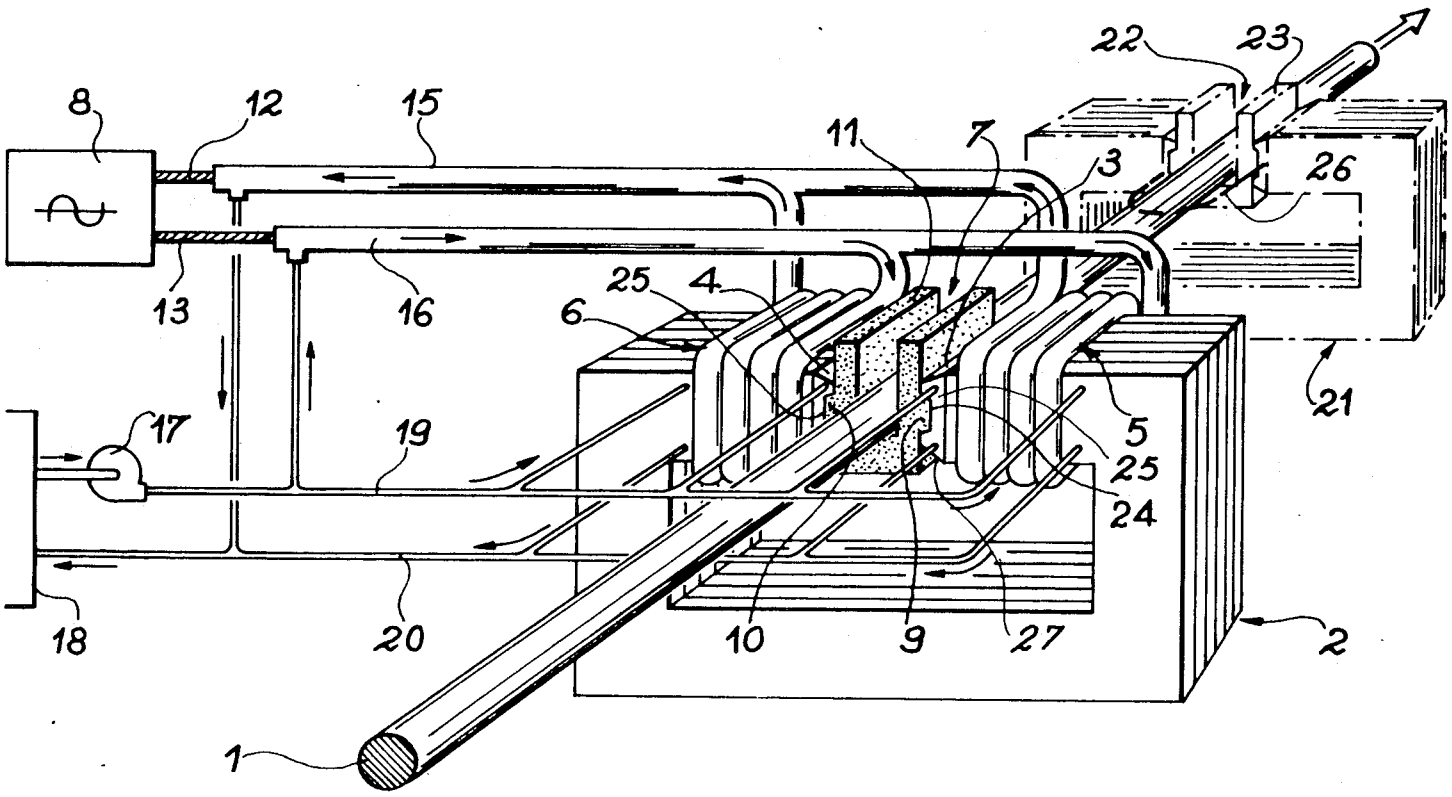
1
2
3
4
5
6
7
8
9
10
11
12
13
15
16
17
18
19
20
21
22
23
24
25
25
26
27

ELECTROMAGNETIC INDUCTION DEVICE FOR HEATING METAL ELEMENTS

BACKGROUND OF THE INVENTION

The present invention relates to an electromagnetic induction device for heating metal elements. This device more particularly applies to the heat treatment by induction of metal elements and particularly aluminum rods or wires. It is known to carry out heat treatments with the aid of a solenoid inductor within which circulates the metal element to be treated. This type of device has the advantage of being very simple, but also has serious disadvantages. Thus, its efficiency is limited for non-ferrous materials. Moreover, when the metal elements, such as aluminum rods or wires from a continuous casting system, have to be treated, as a result of operating difficulties in the downstream mechanical system, these elements can become mixed up in the solenoid, leading to the deterioration of the elements.

Another type of electromagnetic induction for heating metal elements is also known. This other device comprises a magnetic circuit in the form of a flat or planar loop open at its two facing ends, with field windings onto the circuit. The metal element to be heated is placed in the air gap between the two ends of the loop. This device is described in French patent application No. 2489645, filed on Aug. 27, 1981 by the present applicant. Although this device does not suffer from the disadvantage of being subject to deterioration during the displacement of the metal wires to be treated, it still has a very limited efficiency.

The limited efficiency is essentially due to the location of the field windings on the magnetic circuit, together with the losses occurring in the magnetic circuit and windings. Thus, these windings are relatively remote from the air gap and the efficiency is relatively low due to eddy current losses and heat losses.

SUMMARY OF THE INVENTION

The object of the present invention is to obviate the afore-mentioned disadvantages and provide an electromagnetic induction device for heating metal elements having a high efficiency, in which the heat losses and eddy current losses are minimized. The shape of the device also makes it possible to heat metal elements in the form of wires or bars or wires circulating in a continuous manner in the air gap without any risk of deterioration.

The present invention therefore specifically relates to an electromagnetic induction device for heating metal elements having at least one flat loop magnetic circuit open at two facing ends, an inductor wound onto the magnetic circuit and the element to be heated positioned between the air gap located between the two ends of the loop, wherein the inductor comprises two windings wound onto the magnetic circuit, respectively in the vicinity of the two ends of the loop each winding being wound around an axis passing through the respective end of the loop, these windings being respectively supplied by in-phase alternating currents, each end of the loop becoming thinner towards the air gap in the form of a chamfer. The chamfer is formed over the entire circumference of each end of the loop. The magnetic circuit has, at least in the vicinity of the ends, cooling means constituted by at least one tube traversed by a cooling fluid and positioned within the magnetic circuit.

According to another feature, the windings incorporate cooling means.

According to another feature, the magnetic circuit is constituted by an assembly of plates, respectively cut in the form of elementary loops open at both ends, these plates being cut and assembled so that their ends form the chamfers.

According to another feature, the cooling tube within the magnetic circuit is constituted by hollow plates of the circuit.

According to another feature, a slot is cut on each of the faces of the loop ends, perpendicular to the direction of the field produced by the coil and perpendicular to the plane of the magnetic circuit loop.

According to another feature, each winding is constituted by a cable having several strands, these strands being wound around the inductor in the vicinity of the corresponding end of the loop.

According to another feature, the cooling means of each loop are constituted by a sheath for containing each cable and traversed by a cooling fluid.

According to another feature, the device comprises at least one pair of juxtaposed, identical magnetic circuits which are positioned parallel to one another in such a way that their air gaps face one another, the winding wound onto one of the magnetic circuits being supplied by an alternating current which is in phase with the alternating current supplying the other winding.

BRIEF DESCRIPTION OF THE DRAWING

The single FIGURE shows an induction heating apparatus embodying the present invention.

DESCRIPTION OF THE DRAWING AND PREFERRED EMBODIMENTS

The features and advantages of the invention can best be gathered from the following description, with reference to the single attached drawing diagrammatically showing a device according to the invention.

This electromagnetic induction device makes it possible to heat metal elements and particularly aluminum bars or wires from a continuous casting system which are to undergo heat treatment by reheating up to e.g. 520° C.

The device comprises at least one flat loop magnetic circuit 2 open at its two facing ends 3, 4. This device also comprises an inductor with two windings 5, 6 wound onto the magnetic circuit 2, respectively in the vicinity of the two loop ends 3, 4. The metal element to be heated is placed in the air gap 7 between the two loop ends. The windings 5, 6 are respectively supplied by in-phase alternating currents, e.g. supplied by an alternating current source 8. Each end of the loop of magnetic circuit 2 is shaped like a chamfer directed towards air gap 7. Slots 9, 10 are cut in the faces of ends 3, 4 of the loop of magnetic circuit 2. Slots 9 and 10 are perpendicular to the direction of the field produced by the loops and perpendicular to the plane of the magnetic circuit loop. It should be noted that the chamfers are formed over the entire circumference of each end of the loop.

In the known devices, only chamfers such as 3 and 27 are formed. Thus, eddy current losses occur. In the absence of chamfers such as 25, the magnetic field lines close again perpendicular to the magnetic circuit sheets on passing to the outside of the air gap. One of these lines is shown in broken line form at 26. According to the invention, such magnetic field lines obviously do not exist due to chamfers such as 25. Thus, the eddy current losses are minimized and the efficiency of the device is much better. According to the invention, only those magnetic field lines perpendicular to the two facing faces of the two ends of the loop in the air gap are shown.

The magnetic circuit can be constituted either by soft iron sheets or by ferrite blocks. The chamfers at the opposite ends of the magnetic circuit make it possible to increase the concentration of the magnetic field towards the metal element to be heated. Chamfers 24, 25 also make it possible to reduce the amount of heating of the magnetic circuit due to eddy currents, which occur on the edges of the ends of the magnetic circuit when there are no chamfers. Slots 9, 10 ensure a good mechanical stability of the heated mechanical element in the air gap, particularly when it is in the form of a wire or rod. Thus, the slots make it possible to produce a constant magnetic field in the air gap, preventing the appearance of repulsive forces, which tend to eject the element to be heated from the air gap. Thus, in the absence of a slot, an unstable equilibrium point appears at mid-height of the air gap. A guidance member 11 is placed in air gap 7, in order to improve the guidance of the metal element to be heated, particularly when the latter is in the form to a wire or bar. This guidance member can be e.g. made of a thermally insulating material which is integral with the ends of the loop of magnetic circuit 2 and bears against the bottom of slots 9, 10. Windings 5, 6 are wound onto the ends of loop 2, as close as possible to the air gap, so as to prevent magnetic flux losses. These windings are constituted by cables 12, 13 having several strands (e.g. of copper) and are shown diagrammatically in the drawing.

Cooling means are provided for the windings. In the preferred embodiment of the invention, are formed by plastic sheaths 15, 16 surrounding the cables and in which circulates a cooling liquid from a pump 17 connected to a tank 18 containing the cooling liquid, e.g. water. The cooling of the windings makes it possible to reduce the eddy current losses due to the induction from the magnetic circuit. The efficiency of the device is increased by this type of inductor.

Cooling means for the magnetic circuit 2 are also provided in the vicinity of the ends of the loop. They are formed by tubes 19, 20, connected e.g. to pump 17 and to tank 18 making it possible to circulate a cooling liquid in tubes within magnetic circuit 2. These cooling circuits are known in the art and are consequently not shown in the drawing. The cooling of the iron sheets or ferrite blocks of magnetic circuit 2 makes it possible to increase the efficiency of the device.

The cooling circuit within the magnetic circuit can be formed by an appropriately shaped tube or by a water box adapting to the shape of the magnetic circuit, particularly in the vicinity of each end of the loop. These water boxes can be formed by certain of the plates of the magnetic circuit, which can be hollow. The iron plates or ferrite blocks constituting the magnetic circuit are assembled by known means, which are not shown in the drawings. These plates are cut so as to have the shape of loops and in such a way that after assembly, the ends of the magnetic circuit form chamfers.

The device according to the invention preferably comprises a pair of juxtaposed, parallel and identical magnetic circuits 2, 21, in such a way that their air gaps 7, 22 face one another. The second magnetic circuit 21 also comprises two windings (not shown in the drawing), wound at each of the ends thereof, together with guidance means 23 in air gap 22. The windings wound onto the second magnetic circuit 21 are supplied (in manner not shown, but similar to that of windings 5, 6) by an alternating current in phase opposition with the alternating current supplying the windings wound onto magnetic circuit 2. The aluminum rod or wire to be heated travels in thermally insulating guidance members 11, 23.

The supply of the windings of the first and second magnetic circuits 2, 21 by alternating currents in phase opposition makes it possible to respectively produce in the air gaps of said windings magnetic fluxes in opposite directions. This arrangement makes it possible to avoid the presence of any magnetic flux in the circuit formed by the element to be heated and by equipment making it possible to manipulate the element. Any magnetic flux in this circuit leads to the appearance of a current prejudicial to the heating of the metal element.

Tests performed on a sample constituted by a diameter 26-mm-aluminum wire have revealed that the efficiency of the device was 65%. The device permitting these tests has, for each of the magnetic circuits, a 45-mm-wide air gap. The windings for these tests are supplied with an alternating current with an intensity close to 2500 A and having a frequency of 280 Hz. The power of the device is 14000 W. The device used for the tests made it possible to raise the temperature of the wire to 520° C.

What is claimed is:

1. An electromagnetic induction device for heating metal elements having at least one flat loop magnetic circuit open at two facing ends, an inductor wound onto said magnetic circuit and the element to be heated positioned between the air gap located between the two ends of the loop, wherein said inductor comprises two windings wound around the magnetic circuit, respectively in the vicinity of the two ends of the loop, said windings being respectively supplied by in phase alternating currents, each end of the loop becoming thinner towards the air gap in the form of a chamfer, this chamfer being formed over the entire circumference of each end of the loop, the magnetic circuit having, at least in the vicinity of said ends, cooling means constituted by at least one tube traversed by a cooling fluid and positioned within the magnetic circuit, wherein the magnetic circuit comprises an assembly of plates respectively cut in the form of elementary loops open at both ends, said plates being cut and assembled in such a way that their ends form the chamfers.

2. A device according to claim 1, wherein the cooling tube within the magnetic circuit is constituted by some plates of said magnetic circuit which are hollow.

3. A device according to claim 2, wherein a slot is cut on each of the faces of the ends of the loop, perpendicular to the direction of the field produced by the coil and perpendicular to the plane of the loop.

4. A device according to claim 2, wherein the windings comprise incorporated cooling means, each winding being constituted by a cable having several strands, wound around the magnetic circuit in the vicinity of the corresponding end of the loop, the cooling means of each winding being constituted by a sheath, each sheath containing a cable and traversed by a cooling fluid.

5. An electromagetic induction device for heating metal elements, comprising at least one pair of identical, juxtaposed, parallel electromagnetic circuits, each electromagnetic circuit comprising at least one flat loop magnetic circuit open at two facing ends being an inductor wound onto said magnetic circuit, and the element to be heated being positioned in the air gap located between the two ends of the loop, wherein said inductor comprises two windings wound around the magnetic circuit, respectively in the vicinity of the two ends of the loop, said windings being respectively supplied by in phase alternating currents, each end of the loop becoming thinner towards the air gap in the form of a chamfer, this chamfer being formed over the entire circumference of each end of the loop, the magnetic circuit having, at least in the vicinity of said ends, cooling means constituted by at least one tube traversed by a cooling fluid and positioned within the magnetic circuit, the air gaps of the circuits facing one another, the windings wound onto one of the circuits of the pair being supplied by in phase alternating currents in phase opposition with in phase alternating currents supplying the windings wound onto the other circuit of the pair.

6. An electromagnetic induction device for heating metal elements having at least one flat loop magnetic circuit open at two facing ends, an inductor wound onto said magnetic circuit and the element to be heated positioned between the air gap located between the two ends of the loop, wherein said inductor comprises two windings wound around the magnetic circuit, respectively in the vicinity of the two ends of the loop, said windings being respectively supplied by in phase alternating currents, each end of the loop becoming thinner towards the air gap in the form of a chamfer, this chamfer being formed over the entire circumference of each end of the loop, the magnetic circuit having, at least in the vicinity of said ends, cooling means constituted by at least one tube traversed by a cooling fluid and positioned within the magnetic circuit, wherein each winding is wound around an axis passing through the respective end of the loop.

* * * * *